United States Patent [19]

Smith et al.

[11] Patent Number: 4,734,789

[45] Date of Patent: Mar. 29, 1988

[54] EDITING COPYING MACHINE

[75] Inventors: Craig A. Smith, Pittsford; Thomas B. Wall; Robert L. Kurtz, both of Fairport; Ruediger W. Knodt, Rochester, all of N.Y.

[73] Assignee: Xerox Corporation, Stamford, Conn.

[21] Appl. No.: 9,862

[22] Filed: Feb. 2, 1987

[51] Int. Cl.[4] ..... G03G 15/04

[52] U.S. Cl. ..... 358/300; 340/705; 340/784; 340/793; 355/7; 355/40

[58] Field of Search ..... 355/7, 14 R, 14 C, 39, 355/40, 133; 178/18, 19, 20; 340/709, 703, 705–707, 712, 716, 717, 784; 346/153.1, 154; 358/296, 300; 430/793

[56] References Cited

U.S. PATENT DOCUMENTS

| | | | |
|---|---|---|---|
| 4,303,332 | 12/1981 | Sakai | 355/14 R |
| 4,371,898 | 2/1983 | Nakamura | 358/300 |
| 4,394,087 | 7/1983 | Irie et al. | 355/14 E |
| 4,475,239 | 10/1984 | van Raamsdonk | 382/57 |
| 4,553,261 | 11/1985 | Froessl | 382/57 |
| 4,558,757 | 12/1985 | Mori et al. | 178/18 |
| 4,567,480 | 1/1986 | Blanchard | 340/712 |
| 4,582,417 | 4/1986 | Yagasaki et al. | 355/7 |
| 4,609,776 | 9/1986 | Murakami et al. | 178/18 |
| 4,653,899 | 3/1987 | Watanabe | 355/14 R |
| 4,674,861 | 6/1987 | Kawamura | 355/4 |

FOREIGN PATENT DOCUMENTS

| | | | |
|---|---|---|---|
| 167359 | 1/1986 | European Pat. Off. . | |
| 0087446 | 5/1984 | Japan | 355/75 |
| 0166969 | 8/1985 | Japan | 355/4 |

*Primary Examiner*—A. T. Grimley
*Assistant Examiner*—John G. Smith
*Attorney, Agent, or Firm*—H. Fleischer; J. E. Beck; R. Zibelli

[57] ABSTRACT

An apparatus in which an altered copy of an original document is produced. An editing device associated with an electrophotographic printing machine changes the information in the original document and generates a signal indicative of the changes therein. A liquid crystal display overlays the original document. The areas selected for editing are indicated on the liquid crystal display.

27 Claims, 7 Drawing Figures

EDITING COPYING MACHINE

This invention relates generally to an electrophotographic printing system, and more particularly concerns an electrophotographic printing machine having associated therewith an information data editor capable of designating the regions of the document being edited.

Generally, an electrophotographic printing machine forms successive copies of an original document. Recent printing machines are also designed to reproduce an altered copy of the original document, as well as an identical copy of the original document. Thus, the printing machine will erase unnecessary data on the original document, and may add new data thereto. In this way, the printing machine performs an information data editing function which significantly reduces the labor and time in preparing revised copies from the existing original document. In electrophotographic printing, a latent image is recorded on a photoconductive surface, developed, and the resultant powder image transferred to a copy sheet. The powder image is then fused to the copy sheet. The latent image of the original document is formed by scanning the original document and projecting a light image thereof onto the charged portion of the photoconductive surface so as to selectively discharge the charge thereon. The latent image is edited by superimposing thereover an electrically modulated beam, such as a modulated laser beam, or the like. The modulated laser beam adds additional information or erases information from the latent image. In this way, the resultant copy is altered from the original document. Various techniques have been devised for transmitting an electrical signal to modulate the laser so that the desired information is recorded on the latent image. By way of example, the Panasonic E2S copier system uses an electronic pad to edit, move or delete information on a copy, and the Panasonic electronic print board allows information recorded on a blackboard sized electronic board to be copied automatically by a copying machine on a copy sheet. In order to define the area that is to be altered, the coordinates of the original document to be modified must be transmitted to the printing machine. The NP 3525 Copier manufactured by the Canon Corportion employs an edit pad which enables selected portions of a copy to be color highlighted or deleted. These systems all have a common shortcoming in that the operator has no way of knowing whether or not the intended areas have been disignated, or the capability to review the edited material. Only after a copy is produced can the operator review the edited information to determine if it has been correctly reproduced on the copy. Digitizers may be employed to define the coordinates of the original document to be altered. Exemplary digitizers are described in U.S. Pat. Nos. 4,088,842; 3,904,822; 4,080,515; 4,243,843; 4,368,351; and 4,368,352. Thus, it is feasible to employ a digitizer to define the coordinates of the original document to be altered or where additional information is to be inserted into the copy. Various techniques have been devised for modifying copies of an original document. The following disclosures appear to be relevant:

U.S. Pat. No. 4,558,757, Patentee: Mori et al., Issued: Dec. 17, 1985.

U.S. Pat. No. 4,609,776, Patentee: Murakami et al., Issued: Sept. 2, 1986.

European Patent Publication No. 167,359, Published Jan. 8, 1986, Inventor: Kunio.

U.S. patent application Ser. No. 861,891, Filed: May 12, 1986, Applicant: Shenoy et al.

The disclosures of the above-identified art may be briefly summarized as follows:

Mori et al. discloses a position coordinate input device including an input plate made from a transparent material. The plate is supported by four elastic support members. Included with each support is a detector for detecting an externally applied force and transferring the coordinates to another apparatus.

Murakami et al. describes a coordinate input device with a display made from a liquid crystal material. A tablet, on which the display is positioned, is provided for detecting the coordinate position. A magnetic pen is used to define the coordinates on the tablet.

Kunio discloses an image information input apparatus which permits the input of image information supplementary to the original information without first physically processing the original. The original to be copied is covered by a transparent plate on which surface additional information is recorded with a felt pen. A reading device reads the original and/or the additional information.

Shenoy et al. describes an editing pad which defines the coordinates of the original document to be altered on the copy and enables the operator to add and/or delete information from the original on the copy. The editing device is associated with an electrophotographic printing machine and generates a signal indicative of the changes in the information on the original document. This signal is stored in an erasable read-only memory. The erasable read-only memory is inserted into the printing machine to control the formation of the copies so as to correspond to the edited original document.

In accordance with one aspect of the present invention, there is provided an apparatus for producing an altered copy of an original document. Means reproduce copies of the original document. Means, located remotely from the reproducing means, change the information of the original document and generate a signal indicative of the changes in the original document. Means, operatively associated with the changing means and arranged to overlay the original document, is provided for indicating the region of the original document being altered on the copy.

Pursuant to another aspect of the present invention, there is provided a copying system for reproducing a substantially identical or altered copy of an original document. An electrophotographic printing machine is adapted to reproduce identical or altered copies of an original document. Operator selectable means change the information of the original document and generate a signal indicative of the changes in the original document. Means, operatively associated with the changing means and arranged to overlay the original document, is provided for indicating the region of the original document being altered on the copy.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
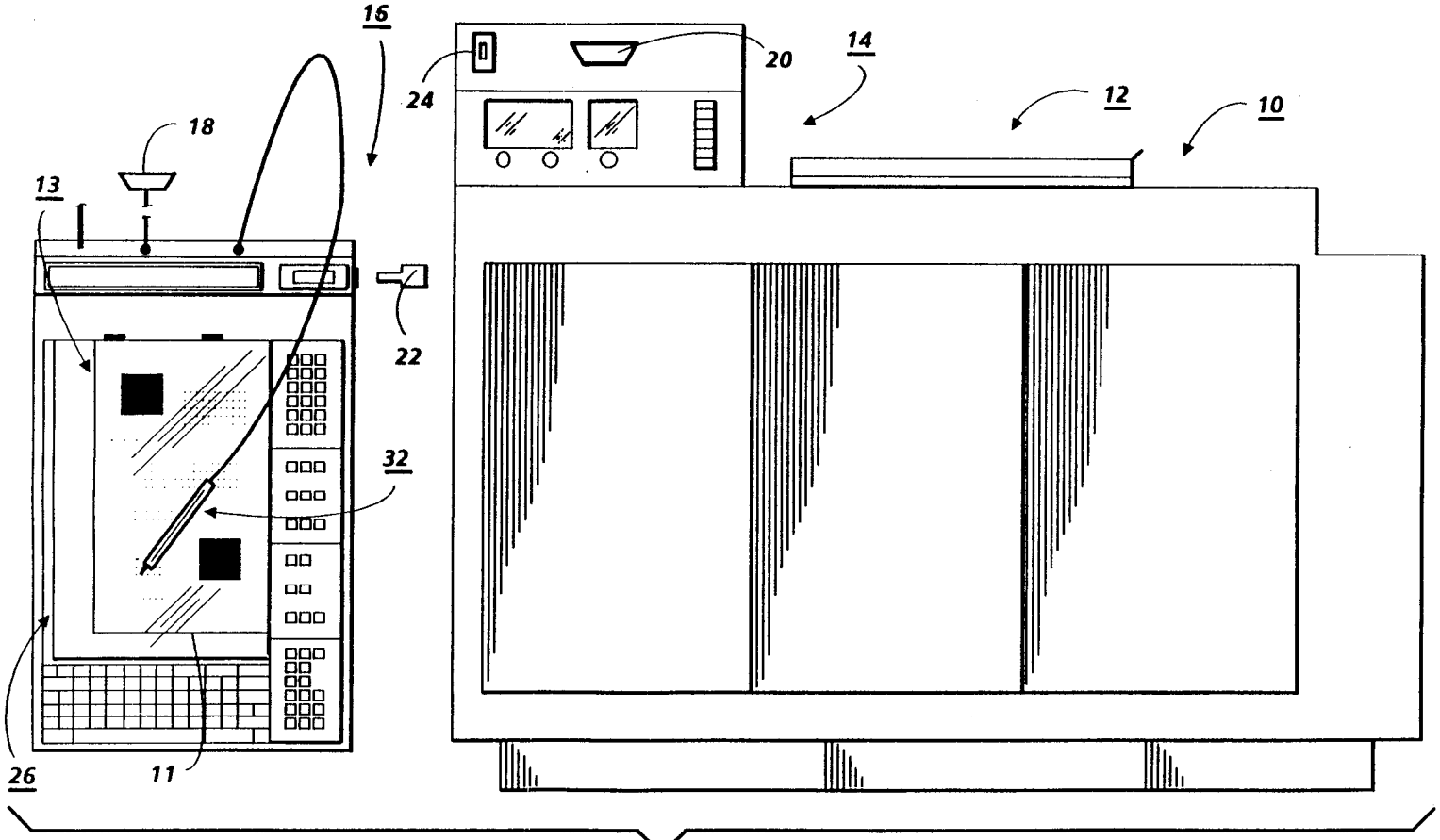
FIG. 1 is a schematic elevational view depicting an illustrative electrophotographic printing machine having the edit pad of the present invention associated therewith.

For a general understanding of the features of the present invention, reference is made to the drawings. In the drawings, like reference numerals have been used throughout to designate identical elements. FIG. 1 schematically depicts the printing system comprising an electrophotographic printing machine for reproducing copies and an edit pad for altering the copies without effecting the original document. It will become evident from the following discussions that the edit pad of the present invention is equally well suited for use in a wide variety of printing systems of other types of devices where it is desired to alter the copy without effecting the original document. The features of the present invention are not specifically limited in their application to the particular embodiment depicted herein.

Referring now to FIG. 1 of the drawings, the printing system and its operation will be described with reference thereto. Inasmuch as the art of eletrophotographic printing is well known, the operation of the printing machine will be described briefly.

The electrophotographic printing machine, generally designated by the reference numeral 10, is capable of producing a stream of copy sheets having information copied on one side only, simplex sheets or on both sides, duplex sheets. A recirculating document feeder 12 is shown positioned above a platen (not shown) at the imaging station of printing machine 10. Document feeder 12 is adapted to feed original documents, in seriatim, to the platen for copying. Document feeder 12 usually operates in a collating mode in which original documents are fed, in seriatim, from a stack in a tray at the top of the feeder to the platen for copying one at a time for each circulation and then returned to the stack. The original documents are placed in the feeder in a predetermined, page sequential order. For example, the first page is on top of the stack and the last page is at the bottom of the stack. The last original document is fed to the platen first and then returned to the top of the stack. The machine operator can control the operation of the printing machine and its related apparatus through the operator control panel, designated generally by the reference numeral 14, and the edit pad, designated generally by the reference numeral 16. If desired, the recirculating document handling unit may be pivoted in an upward direction while the machine operator manually places an original document on the platen of the printing machine. In this mode of operation, the recirculating document handler is inoperative. Edit pad 16 is connected to the electrophotographic printing machine by an RS232 connector 18 which plugs into adapter 20 on control panel 14 of printing machine 10. If the edit pad is positioned remotely from printing machine 10, the changes in the copy are stored in a portable memory key 22 which is initially positioned in edit pad 16 to store the requisite changes. Thereafter, memory key 22 is inserted into the receptacle 24 in control panel 14 of printing machine 10 so as to control the printing machine to adjust the alterations in the copy, as required. An original document 11 is positioned on a digitizing area, indicated generally by the reference numeral 26. An indicating sheet, shown generally by the reference numeral 13 covers the original document 11. Thus, the original document 11 is interposed or sandwiched between indicating sheet 13 and digitizing area 26. A stylus, indicated generally by the reference numeral 32, is used to define the coordinates of the original document 11 to be altered. The stylus is positioned in contact with indicating sheet 13 over the regions of the original document 11 to be altered. Indicating sheet 13 is normally transparent. The regions of the indicating sheet 13 defined by the coordinates designated by stylus 32 become substantially less transparent, e.g., these regions darken, become opaque or colored. In this manner, the regions of the original document that are to be altered in the copy are clearly identified to the operator.

With continued reference to FIG. 1, an electrophotographic printing machine generally includes a belt having a photoconductive surface deposited on a conductive substrate. The belt advances successive portions of the photoconductive surface to various processing stations disposed about the path of movement thereof. Initially, a portion of the belt passes through a charging station. At the charging station, a corona generating device charges the photoconductive surface of the belt to a relatively high, substantially uniform potential. Thereafter, the charged portion of the photoconductive surface is advanced through the imaging station. At the imaging station, a lamp flashes light rays onto original document 11. The light rays reflected from the original document are transmitted through a lens forming a light image thereof. These light rays are focused onto the charged portion of the photoconductive surface to selectively dissipate the charge thereon. This records an electrostatic latent image on the photoconductive surface which corresponds to the informational areas contained within the original document disposed upon the platen. If it is desired to erase selected portions of the original document or to add additional material thereto, a write system is actuated. The write system includes a laser imaging system which generates a modulated laser beam for selectively irradiating charged portions of the photoconductive surface to add additional information to the copy or to delete information therefrom. If it is desired to move information on the original document, the lens is automatically moved from its initial positioned coordinates to the desired new positional coordinates. In this way, information on the original document may be translated to new coordinates on the copy sheet. After the electrostatic latent image is recorded on the photoconductive surface, the belt advances it through a development station. At the development station, a magnetic brush development system transports a developer mixture of carrier granules and toner particles into contact with the electrostatic latent image recorded on the photoconductive surface. The toner particles are attracted from the carrier granules to the electrostatic latent image forming a toner powder image on the photoconductive surface of the belt. The development system includes at least two developer units. One of the developer units has black toner particles therein while the other developer unit includes toner particles of a selected color. In this way, the resultant copy may be reproduced in a desired color other than black or have portions thereof color highlighted. In either case, the toner particles are attracted from the carrier granules to the latent image forming a toner powder image on the photoconductive surface. After development, the belt advances the toner powder image to a transfer station. At the transfer station, a copy sheet is moved into contact with the toner powder image. A corona generating device sprays ions onto the backside of the copy sheet. This attracts the toner powder image from the photoconductive surface to the copy sheet. After transfer, the copy sheet moves to the fusing station. The fusing station includes a fuser assembly which permanently affixes the transferred toner powder image to the copy sheet. By way of example, the fuser assembly includes a heated fuser roll and back-up roll. The copy sheet passes between the fuser roll and back-up roll with the toner powder contacting the fuser roll. In this manner, the toner powder image is permanently affixed to the copy sheet. After fusing, a conveyor belt guides the advancing sheet to the catch tray for subsequent removal from the printing machine by the operator. Alternatively, the advancing sheet may be guided to a finisihing station wherein a plurality of sets may be formed with the copy sheets being either stapled or bound to one another.

Edit pad 16 is designed to control the alterations to be made on the copy sheet. If the edit pad is located remotely from the printing machine, the altered information is stored in memory key 22. Alternatively, if the edit pad 16 is connected by connector 18, i.e. an RS232 connector, to the printing machine, the altered information is transmitted directly to the printing machine so as to immediately modify copies being reproduced thereby. It is believed that the foregoing description is sufficient for purposes of the present application to describe the general operation of the printing system incorporating the features of the present invention therein.

Figure 2:
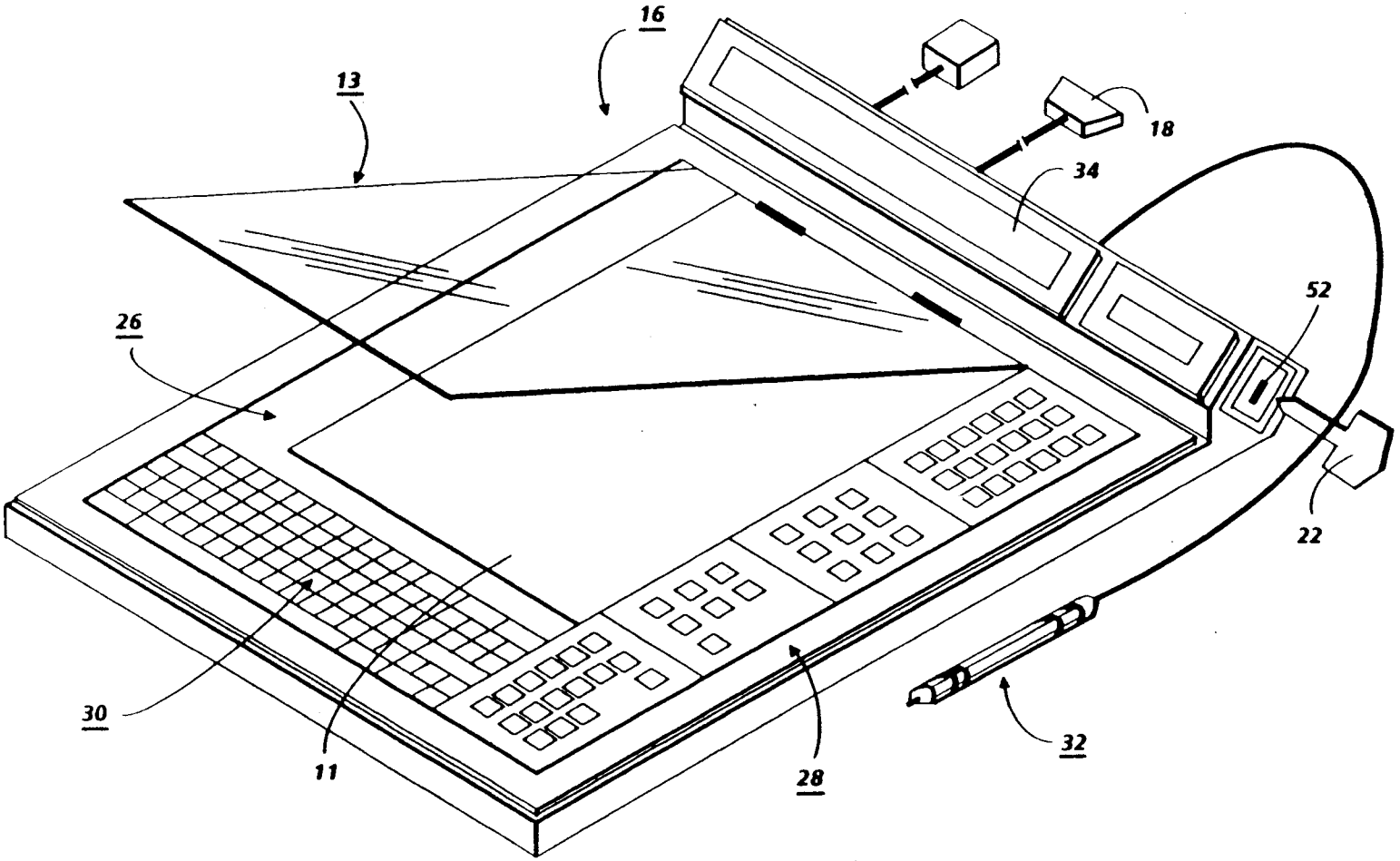
FIG. 2 is a perspective view of the FIG. 1 edit pad.

Referring now to FIG. 2, there is shown the detailed structure of edit pad 16. Edit pad 16 includes a digitizing area 26, an adjacent menu selection area, indicated generally by the reference numeral 28, a keyboard area, indicated generally by the reference numeral 30, and indicating sheet 13. Original document 11 is positioned on digitizing area 26. Indicating sheet 13 is pivoted to overlay original document 11 and the coordinates of the original document desired to be altered are identified by positioning stylus 32 in contact therewith. One skilled in the art will appreciate that instead of stylus 32, the operator's finger, or any other non-connected pointing device may be used. The region of indicating sheet 13, defined by positioning stylus 32 in contact therewith to define the coordinates of the original document 11 to be altered, darken. This identifies the region of the original document being edited. Positional coordinate information is transmitted either directly to the printing machine through the RS232 channel, indicated by the reference numeral 18, or to memory key 22. In either case, any suitable digitizer may be employed. Suitable digitiing schemes are disclosed in U.S. Pat. Nos. 4,368,351; 4,368,352; and 4,243,843, the relevant portions thereof are hereby being incorporated into the present application. Menu selection area 28 includes a plurality of editing, and job programming features which may be actuated by locating stylus 32 in contact with the selected block. Positioning the stylus 32 in contact with the selected block in menu selection area 28 defines the operation to be performed on the selected text within the original document. Alternatively, additional text may be furnished to the original document by selecting the appropriate block in the menu selection area and typing in the desired information by selecting the keys of keyboard area 30 with stylus 32. One skilled in the art will appreciate that a conventional typing keyboard may be employed in lieu of a keyboard area actuated by stylus 32. The information being added to the copy of the original document is displayed on display 34 which is a forty character, two line, liquid crystal display (LCD) for the exclusive purpose of illustrating the input data being added to the copy of the original document. The LCD display is also programmed to provide step by step instructions for using the edit pad. Other suitable displays are cathode ray tubes (CRT). Memory key 22 is an erasable programmable, read only memory. Alternatively, memory key 22 may be a low power or self powered random access memory or an optical memory. By way of example, a 16K bit chip may be used to store the information to be used to program the operations of a remotely located printing machine.

Figure 3:
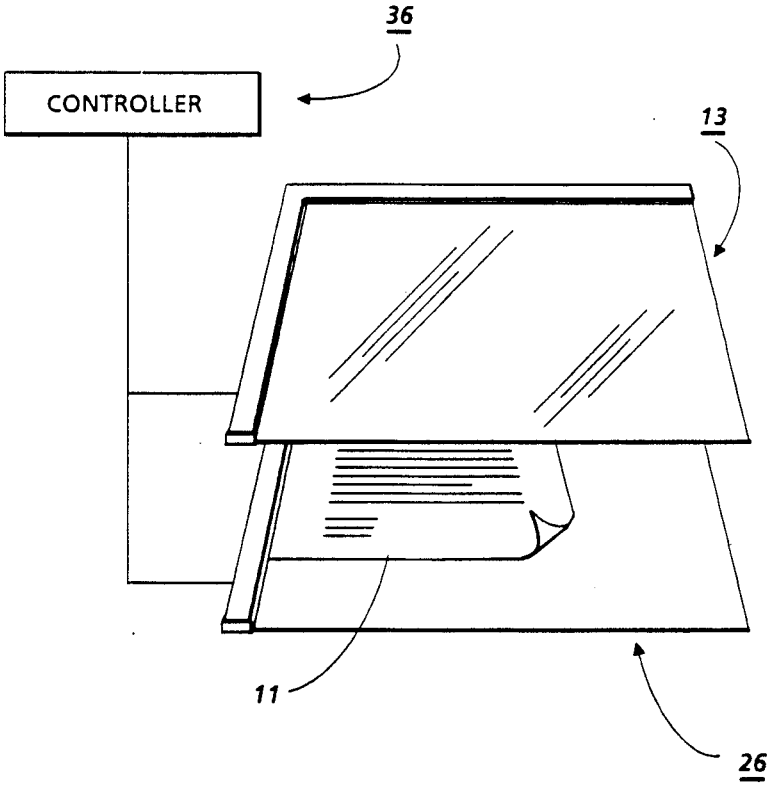
FIG. 3 is a schematic, perspective view of the FIG. 1 edit pad illustrating the original document interposed between the digitizer and the indicating sheet with the digitizer and overlay sheet being coupled to one another by a controller.

Referring now to FIG. 3, original document 26 is positioned on digitizing area 11 and indicating sheet 13 positioned thereover. A microcontroller, indicated generally by the reference numeral 36 couples digitizing area 26 to indicating sheet 13. Preferably, indicating sheet 13 is a LCD (liquid crystal display) panel of the type having a plurality of horizontal electrodes and a plurality of vertical electrodes arranged in an intersecting manner. The electrodes are made from a transparent conductive material, such a indium tin oxide, coated on opposed, spaced galss plates with a liquid crystal medium interposed therebetween. When a voltage is applied to the electrodes, the liquid crystal medium becomes clear, at other times it is less transparent or milky. Normally, a voltage is applied between the electrodes and the indicating sheet 13 is substantially transparent. However, when stylus 32 is positioned in contact with indicating sheet 13, digitizing area 26 generates signal defining the positional coordiniates to controller 36. Microcontroller 36, in turn, sets the voltage of the electrodes corresponding to the positioned coordinate to about zero volts. The liquid crystals medium, in the vicinity of the defined positional coordinates becomes milky, i.e. it darkens and becomes less transparent, to identify the region of the original document 11 selected for editing. Alternatively, indicating sheet 13 may be normally transparent and darken when a change in voltage occurs. When the designated areas of indicating sheet 13 darken, the regions of original document 11 located therebeneath are still readable by the operator. This type of LCD panel is substantially rigid. However, one skilled in the art will appreciate that it is advantageous to use a flexible LCD panel for indicating sheet 13. A flexible LCD panel uses a micro-dispersion to the the liquid crystal medium, i.e. minute, plastic spheres or droplets. This material is coated on opposed sheets of plastic to form a flexible LCD panel for use as an indicating sheet. Flexible LCD panels are made by the Taliq Corporation, 265 North Wisman, Mountain View, Calif.

Figure 4:
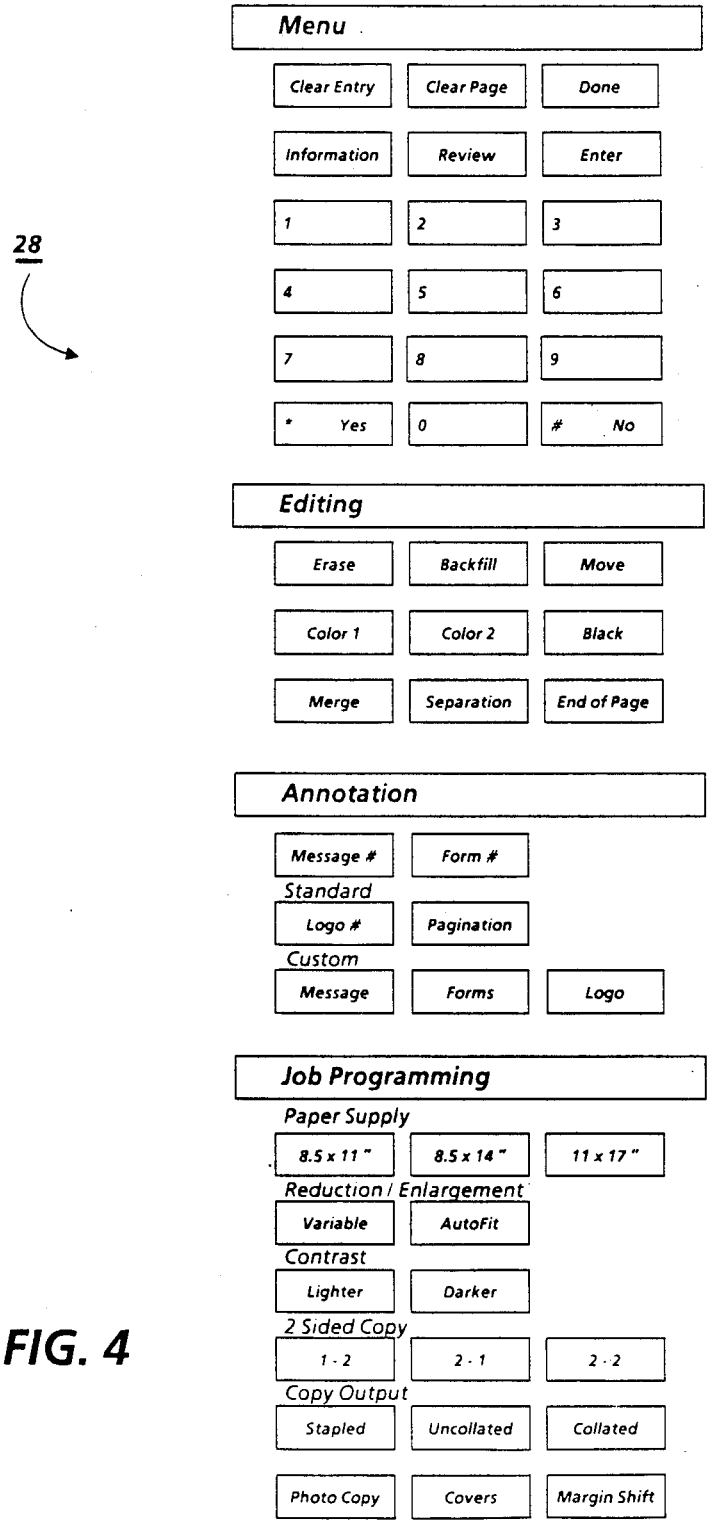
FIG. 4 shows the overlay used on the FIG. 2 edit pad.

Turning now to FIG. 4, there is shown the detailed structure of overlay menu area 28. As shown thereat, each block defines a specific operation to be performed on the copy. Each block is located in a discrete positional coordinate on the digitizing area. In this way, actuation of a specific block by stylus 32 defines specific positional coordinates which actuate the logic control to perform specific operations within the printing machine. By way of example, if it is desired to erase selected information from the copy sheet, the stylus is positioned in contact with the erase block of overlay menu 28. The digitizing area transmits signal indicative of the erase positional coordinates. The information desired to be erased is selected and the positional coordinates thereof are also identified by the digitizing area. The digitizing area transmits a signal defining the positional coordinates of the information desired to be deleted from the copy and indicating sheet 13 darkens in the regions corresponding to these positional coordinates designating the area being edited on the original document. The operation to be performed on the copy, i.e. erase the information, is now initiated. The erase signal actuates a light emitting diode array (LED) or the laser beam which is modulated to erase the selected portions of the original document from the copy sheet. This is achieved by illuminating selected portions of the electrostatic latent image after the latent image of the original document is recorded on the photoconductive surface. This deletes the desired information therefrom. If it were desired to move a selected block of text in the copy, the stylus would be positioned over the move block in overlay menu 28. This generates a signal to the control circuitry which moves the lens to the new positional coordinates during exposure of the original document. In this way, the light image of the selected portion of the original document is shifted so as to shift a selected portion of the electrostatic latent image recorded on the photoconductive surface. In this way, the selected information on the original document is moved on the copy sheet to the new positioned coordinates. Movement of the lens determines the inboard and outboard position of the information. In the process direction, latent image placement is delayed relevant to the position of the copy sheet. It is thus clear that by selecting various blocks on the overlay menu 28, the corresponding digitizing area positional coordinates transmit a signal which the causes the region of indicating sheet 13 corresponding to the edited region of original document 11 to become opaque. Thereafter, the respective operations within the printing machine to effect the desired change on the copy sheet are actuated.

Figure 5:
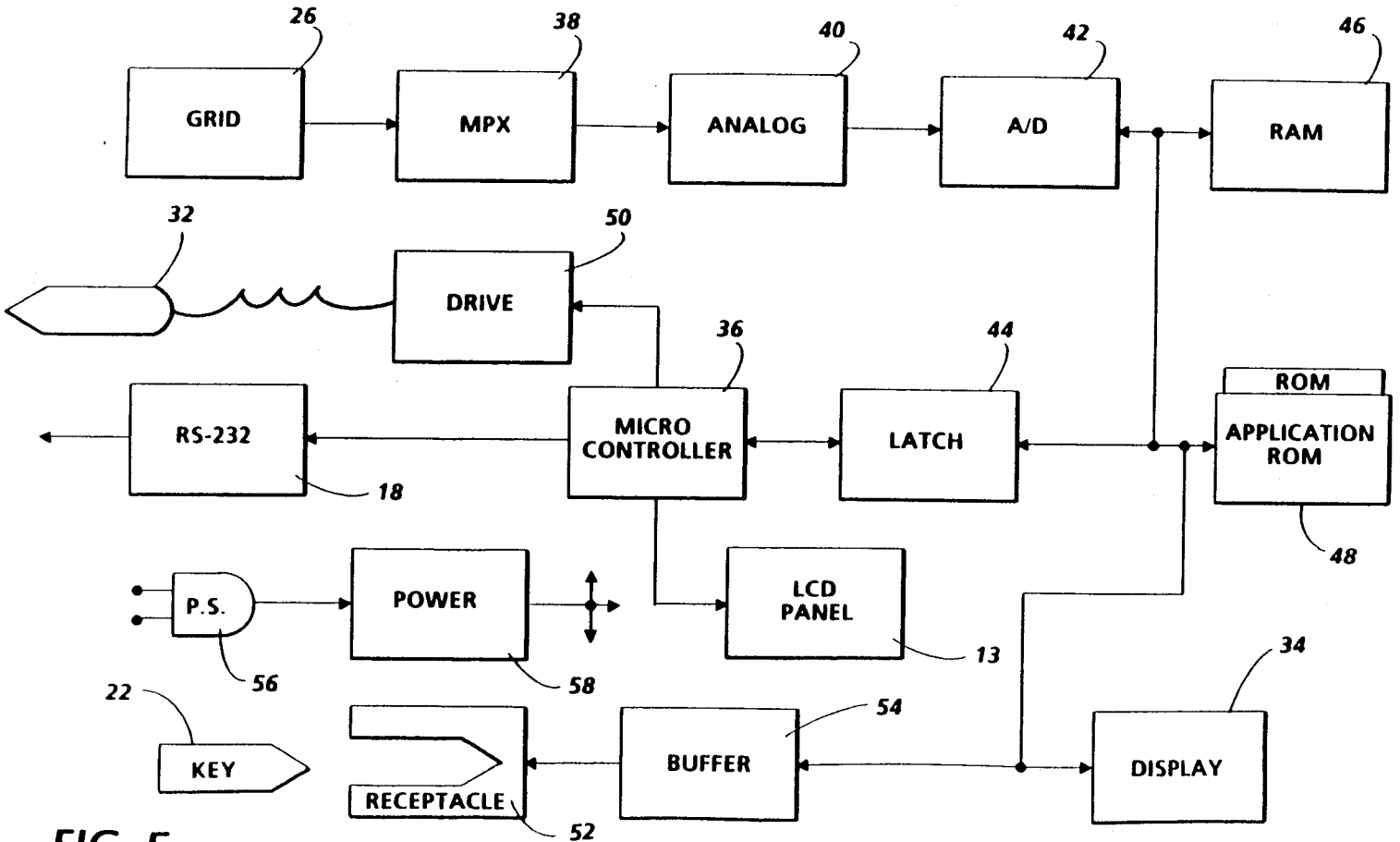
FIG. 5 is block diagram of the FIG. 2 edit pad.

Turning now to FIG. 5, there is shown a block diagram of the electronics package being employed. An Intel 8051/8031 microcontroller chip 36 forms the basic electronics control package. Microcontroller chip 36 receives information from digitizing area 26. This information is transmitted through a multiplexing circuit 38, an analog circuit 40, and an analog to digital circuit 42 and a latching circuit 44. The output from the analog to digital converter is also transmitted to a random access memory chip 46. Software to interpret the coordinates and run the digitizer reside in read only memory chip 48. The digitizing area 26 output is also connected to display 34. Microcontroller 36 controls drive circuit 50 which is coupled to stylus 32, and LCD panel 13. Memory key 22 is received in receptacle 52 which is connected to display 34 and microcontroller 36 via buffer 54. Plug 56 connects power supply 58 to an external power source. Microcontroller 36 obtains positional data from the digitizing areas, formats the data for transmission, and places the data into the memory key 22 or transmits the data by the RS232 channel 18 to printing machine 10, and controls the voltage levels of the electrodes of LCD panel 13. It also controls the data bus line and several peripherals, i.e. display 34, analog to digital converter 42, non-volatile memory key receptacle 52, programmable read only memory 48, and random access memory 46. Read only memory 48 and random access memory 46 each preferably have 4K of memory. Analog to digital converter 42 is connected to analog circuit 40 supporting the digitizing area 26 and provides raw digital positional information to microcontroller 36. Key receptacle 52 forms a physical socket for the non-volatile memory key 22 and connects it electrically to the controller bus line. There is no need for buffer 54 located between the data bus line and the key receptacle if the edit pad is non-operative when the key is removed. However, if the edit pad operates with or without the key, line buffering is required and buffer 54 is necessary.

Figure 6:
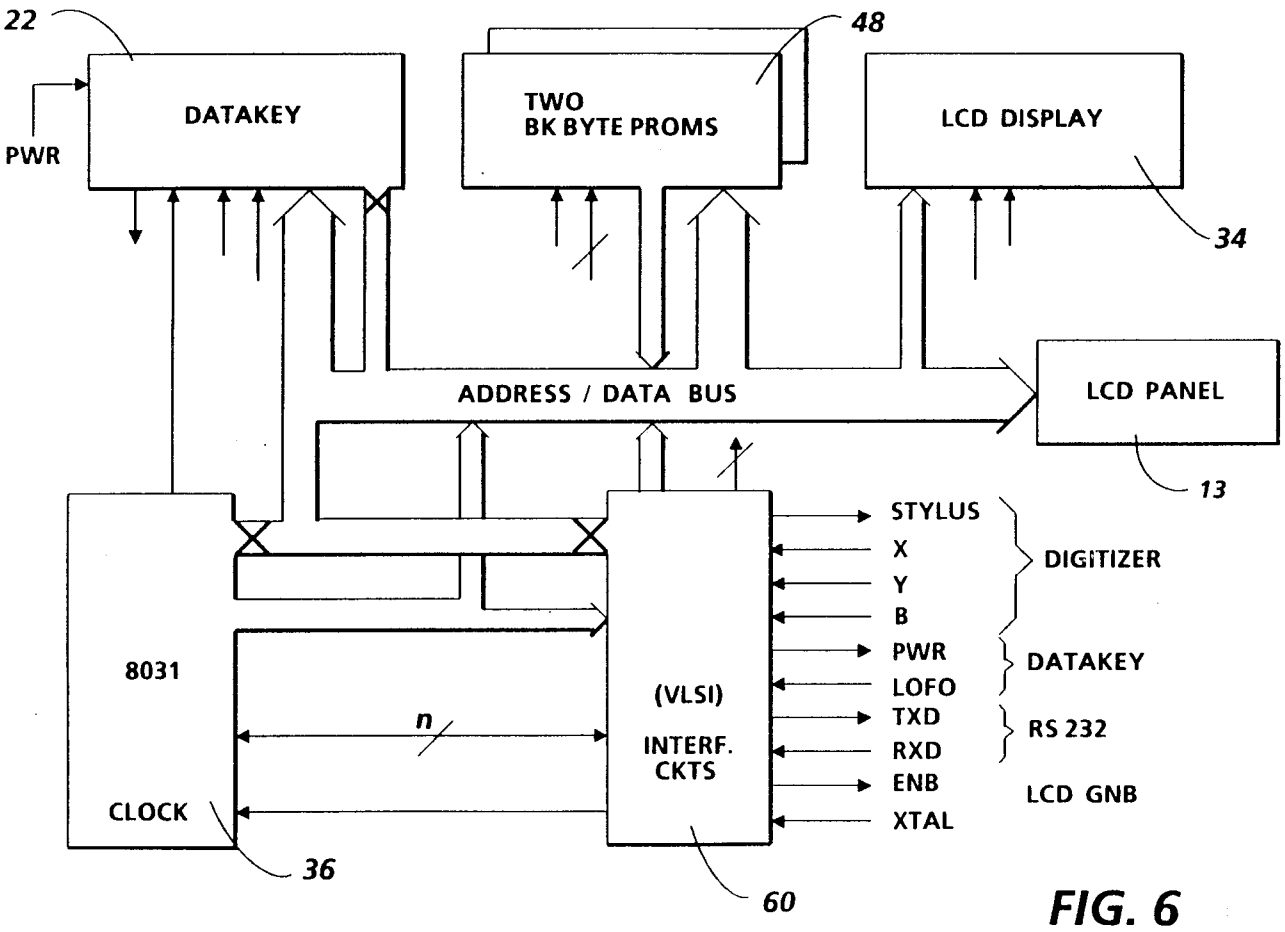
FIG. 6 is a logic diagram illustrating the logic circuitry employed in the FIG. 2 edit pad.
Figure 7:
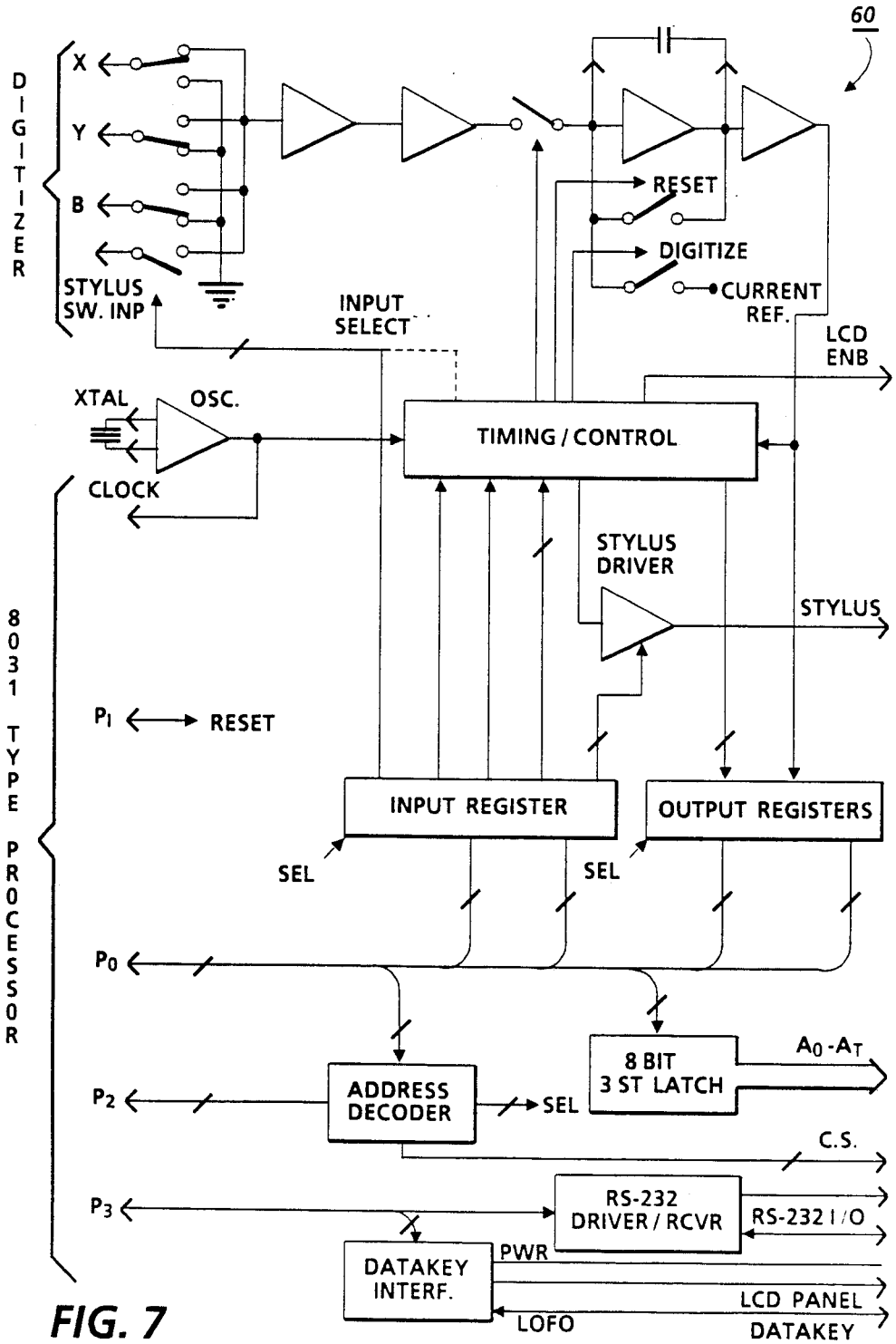
FIG. 7 is a logic diagram of the FIG. 5 VLSI circuitry.

Referring now to FIG. 6, there is is shown another block diagram of edit pad 16. As shown thereat, data key 22, read only memory 48, and display 34 are connected to microcontroller 36, which, in turn, is connected to interface logic circuit 60 which controls LCD panel 13 as well as the various other functions of edit pad 16. By way of example, interface circuit 60 may be a VLSI chip. The logic diagram for interface circuit 60 is shown in FIG. 7. With continued reference to FIG. 6, interface logic circuit 60 is connected to the digitizing area 26 and microcontroller 36. It is also connected to memory key 22, RS232 connector 18, liquid crystal display 34, and LCD panel 13. One skilled in the art will appreciate that interface circuit 60 is one embodiment and there may be many alternatives and variations which achieve the same functions. Interface circuit 60 is designed to generate the requisite signals to control the LCD panel so that the information being altered on the original document is identified by the regions of the LCD panel corresponding thereto darkening.

In recapitulation, it is clear that the edit pad of the present invention includes an indicating sheet overlaying the original document being edited to designate the edited area. The edit pad either stores the information necessary for altering the copy sheet from the original document or transmits this information directly to the printing machine so as to make the alterations in the copy sheet immediately. A digitizing area defines the positional coordinates to be changed, an LCD panel identifies the regions being edited, and an overlay menu effects the desired changes in the copy. In this way, the regions of the original document being altered may be readily previewed by the operator and an altered copy of the original document reproduced by an electrophotographic printing machine.

It is, therefore, evident that there has been provided in accordance with the present invention, an editing pad which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spririt and broad scope of the appended claims.

We claim:

1. An apparatus for producing an altered copy of an original document; including:

means for reproducing copies of an original document;

means, located remotely from said reproducing means, for changing the information of the original document and generating a signal indicative of the changes in the original document, said changing means being adapted to support the original document with the information thereon visible; and means, operatively associated with said changing means and arranged to overlay the original document, for indicating the region of the original document being altered on the copy.

2. An apparatus according to claim 1, wherein said indicating means is normally substantially transparent so the information on the original document is normally visible, said indicating means darkening in the altered region of the original document to designate the region of the original document being altered on the copy.

3. An apparatus according to claim 2, further including means, mounted removably on said changing means, for storing the signals indicative of the changes in the original document, said storing means being adapted to be mounted removably on said reproducing means to transmit the changes in the original document to said reproducing means so that the copy being reproduced is altered in accordance with the change in information on the original document.

4. An apparatus according to claim 3, further including operator connectable means for connecting said changing means to said reproducing means to transmit the changes in the original document to said reproducing means so that the copy being reproduced is altered in accordance with the change in information on the original document.

5. An apparatus according to claim 4, wherein said changing means includes data generator means for writing new information onto the copy of the original document.

6. An apparatus according to claim 5, wherein said changing means includes:

a digitizing area adapted to have the original document positioned thereon; and operator movable means associated with said digitizing area to energize selected regions of said digitizing area to generate a signal defining the positional coordinates of the original document to be altered.

7. An apparatus according to claim 6, wherein said changing means includes operator actuatable command input means for entering commands defining the operation to be performed on the original document to effect the alteration therein.

8. An apparatus according to claim 7, wherein said command input means includes a display of commands that are operator selectable to generate a signal defining the operation to be performed on the original document to effect the alteration therein.

9. An apparatus according to claim 8, wherein said storing means includes a memory device.

10. An apparatus according to claim 9, wherein said data generator means includes a keyboard display.

11. An apparatus according to claim 10, wherein said indicating means includes a liquid crystal display.

12. An apparatus according to claim 11, wherein said liquid crystal display is made from a substantially flexible material.

13. An apparatus according to claim 12, wherein selected keys of said keyboard display are actuatable by said operator movable means to generate a signal corresponding to the new information being added to the copy.

14. An apparatus according to claim 13, wherein said reproducing means includes an electrophotographic printing machine.

15. A copying system for reproducing a substantially identical or altered copy of an original document, including:

an electrophotographic printing machine adapted to reproduce identical or altered copies of an original document;

operator selectable means for changing the information of the original document and generating a signal indicative of the changes in the original document; and means, operatively associated with said changing means and arranged to overlay the original document, for indicating the region of the original document being altered on the copy.

16. A copying system according to claim 15, wherein said indicating means is normally substantially transparent so the information on the original document is normally visible, said indicating means darkening in the altered region of the original document to designate the region of the original document being altered on the copy.

17. A copying system according to claim 16, further including means, mounted removably on said changing means, for storing the signals indicative of the changes in the original document, said storing means being adapted to be mounted removably on said electrophotographic printing machine to transmit the changes in the original document to said electrophotographic printing machine so that the copy being reproduced is altered in accordance with the change in information on the original document.

18. A copying system according to claim 17, further including operator connectable means for connecting said changing means to said electrophotographic printing machine to transmit the changes in the original docoment to said electrophotographic printing machine so that the copy being reproduced is altered in accordance with the change in information on the original document.

19. A copying system according to claim 18, wherein said changing means includes data generator means for writing new information onto the copy of the original document.

20. A copying system according to claim 19, wherein said changing means includes:

a digitizing area adapted to have the original document positioned thereon; and operator movable means associated with said digitizing area to energize selected regions of said digitizing area to generate a signal defining the positional coordinates of the original document to be altered.

21. A copying system according to claim 20, wherein said changing means includes operator actuatable command input means for entering commands defining the operation to be performed on the original document to effect the alteration therein

22. A copying system according to claim 21, wherein said command input means includes a display of commands that are operator selectable to generate a signal defining the operation to be performed on the original document to effect the alteration therein

23. A copying system according to claim 22, wherein said storing means includes a memory device.

24. A copying system according to claim 23, wherein said indicating means includes a liquid crystal display.

25. A copying system according to claim 24, wherein said liquid crystal display is made from a substantially flexible material.

26. A copying system according to claim 25, wherein said data generator means includes a keyboard display.

27. A copying system according to claim 25, wherein selected keys of said keyboard display are actuatable by said operator movable means to generate a signal corresponding to the new information being added to the copy.

* * * * *